United States Patent [19]

Haddox

[11] 4,222,183

[45] Sep. 16, 1980

[54] ATHLETIC SHOE

[76] Inventor: Billy J. Haddox, Rte. 2, Box 535 B, Chesterton, Ind. 46304

[21] Appl. No.: 89,538

[22] Filed: Oct. 29, 1979

[51] Int. Cl.[3] ..... A43B 5/08; A43B 23/00

[52] U.S. Cl. ..... 36/114; 36/8.1; 36/45

[58] Field of Search ..... 36/8.1, 3 A, 3 R, 84, 36/45, 114

[56] References Cited

U.S. PATENT DOCUMENTS

| | | | |
|---|---|---|---|
| 1,227,981 | 5/1917 | Tynes | 36/8.1 |
| 2,185,769 | 1/1940 | Cox | 36/8.1 |
| 2,954,617 | 10/1960 | Yamaguchi | 36/8.1 |

*Primary Examiner*—Patrick D. Lawson
*Attorney, Agent, or Firm*—Walter Leuca

[57] ABSTRACT

This invention is a reinforced ventilated shoe. It is formed with a strip of shoe cover material circumscribing the toe, sole, arch and heel. Reinforcing strips are provided to form an ankle band and parallel instep strips which extend from the toe portion to the ends of the ankle band. A vertically disposed strip connect the heel portion of the circumscribing strip and the back of the ankle band. Side strips connect the ankle band at one end and the other ends of the side strips are bifurcated below the ankle bone and connect the arch portion of the sole at spaced points. Other strips are provided connecting the parallel instep strips and the sole portion of the circumscribing strip; and strips horizontally disposed connecting the parallel instep strips and the vertically disposed strip at the heel. The shoe is provided with air penetratable netting in the spaces between the strips.

6 Claims, 2 Drawing Figures

ATHLETIC SHOE

BACKGROUND OF THE INVENTION

1. Field of the Invention

This invention relates generally to footwear and more particularly to ventilated shoes.

2. Description of the Prior Art

Shoes worn by athletes engaged in strenuous activities such as wrestling are generally ankle length and have a strong construction to withstand the twisting forces and pressures during such activities.

Prior art wrestling shoes are constructed to provide maximum strength characteristics and therefore are not provided with ventilating means since ventilating means diminishes the integrity of the shoe and therefore, the strength. Accordingly, the athlete is rendered very uncomfortable due to the heat to which his feet are subjected.

Though there are ventilated shoes in the prior art, such shoes are not subjected to the extreme pressures that wrestler's shoes are subjected to and are merely incorporated in the shoe as a part of an aesthetic design.

SUMMARY OF THE INVENTION

This invention provides a wrestling shoe having a maximum area constructed with a net material to provide maximum ventilation and at the same time constructed with reinforcing strips connecting strategic areas to provide maximum strength.

The wrestling shoe of this invention is formed from solid shoe cover material (leather, calves skin, cloth, etc.) surrounding the toe, sole, arch and heel, upward along the instep to the ankle, around the ankle, and along the back heel portion of the shoe. Reinforcing side strips are provided connecting the ankle band at one end and the other end is bifurcated below the ankle bone and connected to the arch portion of the sole at spaced points.

Second reinforcing strips are provided connecting the instep shoe covering portion to the surrounding strip and adjacent the arch portion. Third or horizontally disposed strips are provided connecting the instep shoe covering portion and the heel portion intersecting the side strips at the ankle bone.

These reinforcing strips are provided on both sides of the shoe. Netting forms the balance of the upper portion of the shoe. A wrestler's shoe formed in this manner provides shoes having maximum ventilating area and maximum strength.

Other objects and advantages of this invention will become apparent after studying the following detailed description taken with reference to the drawings which illustrate a preferred embodiment of this invention.

DESCRIPTION OF THE PREFERRED EMBODIMENT

Figure 1:
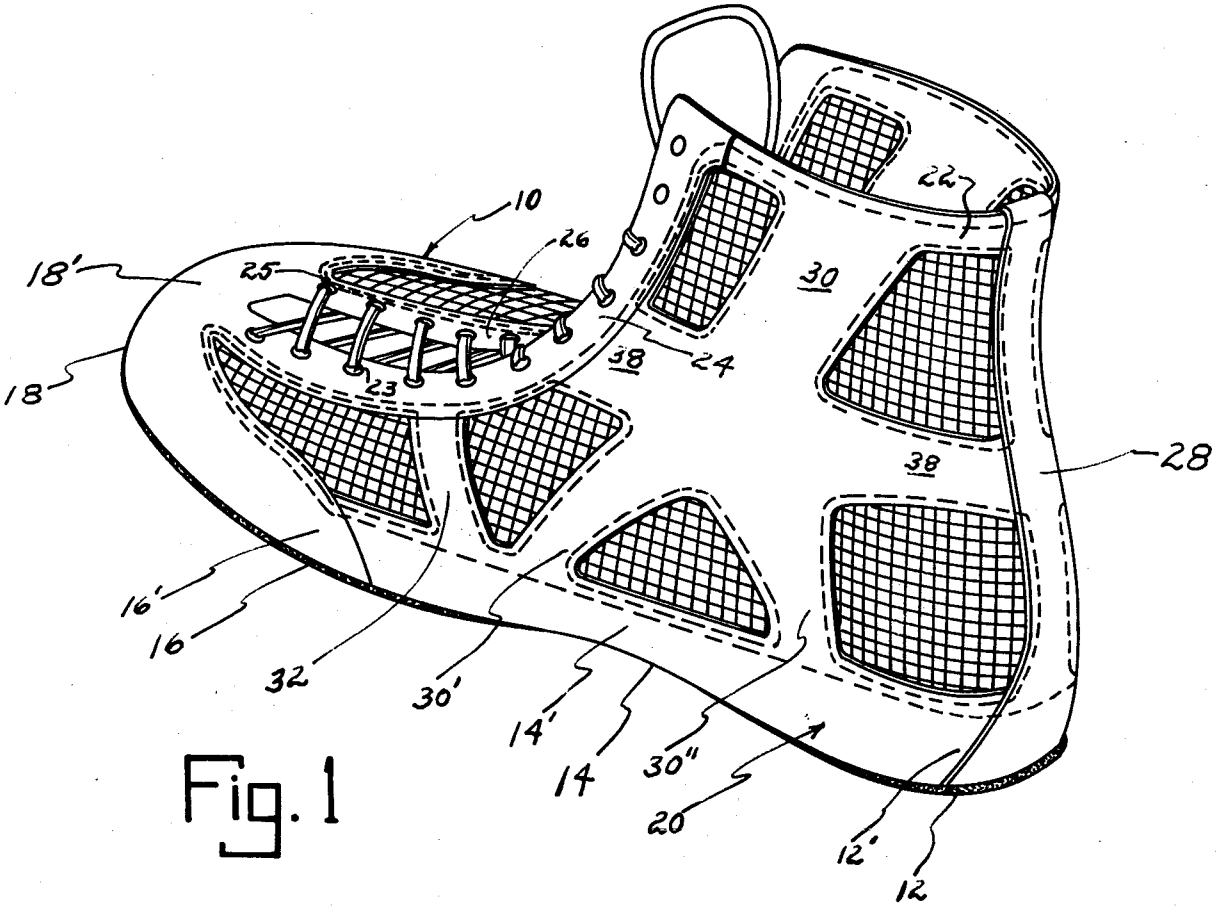
FIG. 1 is a perspective view showing the back and side of my shoe.
Figure 2:
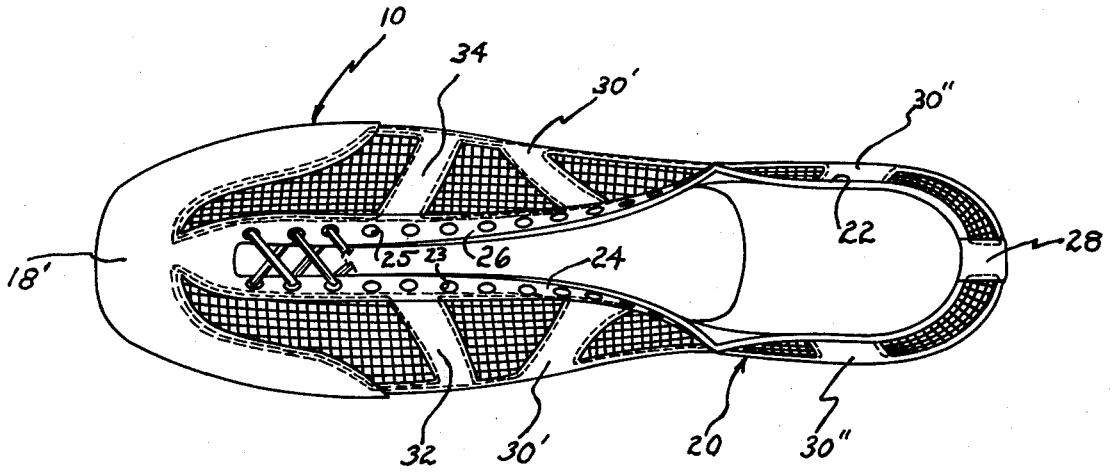
FIG. 2 is a top view of the shoe embodying my invention.

Referring now more particularly to the drawings, reference numeral 10 designates generally the shoe embodying my invention. Only the right shoe of the pair is shown since the left shoe is identical in structure with the exception that it is of the opposite hand. It comprises the usual heel, arch, sole, and toe portions 12, 14, 16 and 18, respectively, and a strip 20 of shoe cover material circumferentially along the edges of the heel, arch, sole and toe portions which I designate by the numerals 12', 14', 16', and 18', respectively. The ankle band component 22 connects to the upper end of the generally parallel instep strip components 24 and 26 which are provided with eyelets 23 and 25 respectively or other customary shoe string fastening means. The other end of strip components 24 and 26 are formed to connect to the toe portion 18' of cover material 20. The back part of the shoe is formed with a vertical strip 28 which connects the back part of ankle band 22 at one end and the back part of heel covering material 12'.

I provide a reinforcing strip 30 on each side of the shoe connecting ankle band 22 at one end and extending along the side thereof over the ankle bone area, below which the reinforcing strip 30 is formed bifurcated as 30' and 30'', the distal ends of which connect at spaced points at the forward and rearward part of arch 14'.

I provide reinforcing strips 32 and 34 on both sides of shoe 10 connecting at one end thereof the mid portion of instep strips 24 and 26 and the other end thereof the sole portion 16' of the cover material 20 at a point adjacent the distal end of bifurcated strip 30'. A further reinforcing strip 38 is provided horizontally disposed and formed to intersect reinforcing strip 30 at the ankle bone part. The other end thereof is formed to connect to vertical strip 28.

I have found that shoes constructed and formed with reinforcing strips illustrated and in the direction and manner described connecting the shoe cover material 20 which circumferentially encompasses the heel, arch, sole and toe of the shoe provides an inordinately strong shoe allowing for maximum area openings over the entire shoe upper surface for adequate ventilation without distorting the shape of the shoe when subjected to violent or forceful pressures such as wrestling or other such athletic activities. I prefer to cover the open spaces with a net material which does not unduly restrict the ventilation of air therethrough. A shoe constructed in accordance with my invention provides shoes suitable for severe athletic abuse without suffering destruction while providing maximum air ventilation therethrough rendering such a shoe comfortable to wear while engaged in such strenuous activity.

I claim:

1. A shoe comprising:

a strip of cover material circumscribing the edge of the heel, arch, sole and toe portions of the bottom component of the shoe;

a second strip of cover material spaced from said first mentioned strip forming an ankle perimeter component;

third and fourth strips of cover material connecting said first mentioned strip at the toe portion and to opposite ends of said second mentioned strip to form instep components;

a fifth strip of cover material vertically disposed connecting the back of the ankle perimeter component and said first mentioned strip at the heel portion;

reinforcing strips, one end thereof connecting the sides of said ankle perimeter component, the other ends thereof being bifurcated and the distal ends of said bifurcated ends connecting said first mentioned strip;

second reinforcing strips, one of the ends thereof connecting said instep components, and the other ends thereof connecting said first mentioned strip at the sole portion thereof;

a horizontally disposed reinforcing strip, one of the ends thereof connecting said instep components, and the other ends thereof connecting said fifth strip; and a net material provided between said strips of cover material and said reinforcing strips.

2. The shoe of claim 1 wherein said bifurcated ends of said first mentioned reinforcing strips are further characterized as being connected to said first mentioned strip at spaced points bridging said arch portion

3. The shoe of claim 1 wherein said net material is further characterized as being air penetratable.

4. A shoe wherein the cover material includes netting and reinforcing strips, the improvement comprising;

a strip circumscribing the edge of the heel, arch, sole and toe portions of the bottom component of the shoe;

a strip spaced from said first mentioned strip forming an ankle perimeter component;

strips connecting said first mentioned strip at the toe portion and to opposite ends of said mentioned strip to form instep components;

a strip vertically disposed connecting the back of the ankle perimeter component and said first mentioned strip at the heel portion thereof;

side strips, one end thereof connecting the sides of said ankle perimeter component, the other ends thereof being bifurcated and the distal ends of said bifurcated ends connecting said first mentioned strip;

instep strips, one of the ends thereof connecting said instep components, and the other ends thereof connecting said first mentioned strip at the sole portion thereof; and horizontally disposed strips, one of the ends thereof connecting said instep components, and the other ends thereof connecting said vertically disposed strip.

5. The shc ⁻ of claim 4 wherein said bifurcated ends of said side strips are further characterized as being connected to said first mentioned strip at spaced points bridging said arch portion.

6. The shoe of claim 4 wherein said net material is further characterized as being air penetratable.

* * * * *